United States Patent [19]

Lii

[11] Patent Number: 4,761,974

[45] Date of Patent: Aug. 9, 1988

[54] COMBINATION LOCK FOR LUGGAGE CASES

[75] Inventor: Shih M. Lii, Taipei, Taiwan

[73] Assignee: Echolag Co., Ltd., Taipei, Taiwan

[21] Appl. No.: 131,038

[22] Filed: Dec. 10, 1987

[51] Int. Cl.[4] ..... E05B 65/48

[52] U.S. Cl. ..... 70/4; 70/75; 70/312

[58] Field of Search ..... 70/2–4, 70/6–7, 72, 73, 74, 75, 76, 312

[56] References Cited

U.S. PATENT DOCUMENTS

| | | | |
|---|---|---|---|
| 3,434,314 | 3/1969 | Atkinson | 70/76 |
| 3,452,563 | 7/1969 | Atkinson | 70/312 |
| 3,545,238 | 12/1970 | Gehrie | 70/312 |
| 4,074,549 | 2/1978 | Yee | 70/7 |

*Primary Examiner*—Robert L. Wolfe

*Attorney, Agent, or Firm*—Shoemaker and Mattare, Ltd.

[57] ABSTRACT

The present invention relates to a combination lock for luggage cases or the like, and more particularly to a combination lock consisting of a staple unit and a hasp unit; said hasp unit comprising a base plate, a locking unit and a hasp; said locking unit comprising a securing mechanism, a combination lock and a body; securing mechanism being provided with a knob slidably fitted into said body, a leaf spring adapted to resiliently and selectively hold said knob in place when said knob is slid to "secure" or "release", and a sliding piece adapted to be slidably disposed between said latching piece and the bottom of casing of said combination lock, said sliding piece comprising an arm adapted to be connected with said knob, a hook adapted to engage with or disengage from said arch of said base plate to have said locking unit secured to or released free said base plate when said knob is moved to "secure" or "release", and a hole adapted to correspond to and be in alignment with latch end of latching piece to allow latch end to fit in when said sliding piece is moved to "secure". If said knob is at "secure" said hook is in engagement with said arch of said base plate, said locking unit being firmly secured to base plate although said dial wheel may be subject to accidental rotation by other articles.

2 Claims, 4 Drawing Sheets

COMBINATION LOCK FOR LUGGAGE CASES

BACKGROUND OF THE INVENTION

The present invention relates to a combination lock for luggage cases or the like, and more particularly to a combination lock having a securing mechanism to prevent the lock unit from disengaging from the base plate, thus ensuring the engagement between the staple unit secured on one part of the luggage case and the hasp unit fixed on the other part of the luggage case even if the dial wheels of combination lock are subject to accidental and unexpected rotation to align with open combination when the lock is locked.

Many kinds of conventional lock means for luggage cases or the like are known, the one as shown in FIG. 1 is an example. The said lock comprises a locking unit L provided with a key hole K and a hasp S, locking unit L being pivotally connected to a base plate (not shown) fixed onto one part of case, which may be a case body, hasp S being connected to locking unit L. When using the lock, first engage hasp S with a staple unit (not shown) fixed onto the other part of the case, which may be a case lid, then push down locking unit L by hand and lock the locking unit by utlizing a key through key hole K.

The said lock is simple in construction, but inconvenient to use as it requires a key to lock and unlock, which necessitates seperately carrying a key which must be brought out and manipulated each time the case is opened or closed.

The shortcomings of the lock as discussed above can be overcome by substituting many known combination locks for key hole K, such as those disclosed in U.S. Pat. No. 4,327,566, 4,462,232, etc. However, a serious disadvantage in using such known combination locks as a locking means for luggage cases is that the dial wheels may be rotated to align in an opening combination by accidental contact with other articles while the case is being carried or moved about, thus causing the locking unit to unlock through the disengagement of the hasp from the staple unit.

The main object of the present invention is to provide a combination lock for luggage cases or the like, having a securing mechanism to keep the hasp disengaging from the staple unit when the dial wheels of the locking unit are subject to accidental contact with other articles so that the luggage cases are able to stay closed.

Another object of the present invention is to provide a combination lock for luggage cases or the like, having a less complicated construction.

SUMMARY OF THE INVENTION

According to the present invention, the combination lock for luggage cases or the like consists of a staple unit attached to one portion of a luggage case such as case lid; and a hasp unit attached to the other portion of a luggage case such as case body, comprising a base plate, a locking unit pivotally connected to said base plate and a hasp pivotally connected to said locking unit; the locking unit further comprising a body, a combination lock and a securing mechanism; the base plate being provided with an arch; the body of said locking unit having a plurality of slots formed side by side to allow the dial wheels of said combination lock to fit in; said combination lock of locking unit further comprising a dial assembly, a latching piece and a casing, said dial assembly utilizing a plurality of dial wheels, each dial wheel being mounted on a sleeve rotatably mounted on a shaft supported inside said casing, each sleeve having a flange at one end consisting of a round arch portion and a flat portion; said latching piece being provided with a plurality of slots corresponding to said dial wheels, two lugs pivotally supported on said casing as a pivot axis of said latching piece and a latch end formed on the front thereof, round arch portion of flange of sleeve being rotatably in contact with said latching piece and pressing said latching piece downwards when dial wheels are in lock combination, flat portion of flange of sleeve being rotatably in contact with said latching piece to allow said latch piece to move upwards when dial wheels are in open combination; said securing mechanism comprising a knob being slidably fitted in said body, a leaf spring being capable of resiliently and selectively holding said knob in place when said knob is slid to and fro, and a sliding piece adapted to be slidably disposed between said latching piece and the bottom of said casing, said sliding piece comprising an arm adapted to be connected with said knob, a hook adapted to engage with or disengage from said arch of base plate to have said locking unit secured to or released from said base plate when said knob is moved to "secure" or "release", and a hole adapted to correspond to and in alignment with said latch end of said latching piece to allow latch end to fit in when sliding piece is moved to "secure" by pushing knob.

BRIEF DESCRIPTION OF THE INVENTION

FIG. 1 is an oblique, perspective view of a conventional locking means for luggage cases or the like.

DETAILED DESCRIPTION OF THE INVENTION

Figure 1:
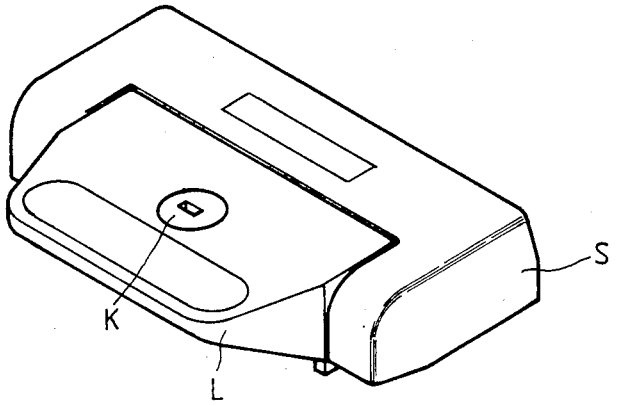
FIG. 1 (PRIOR ART)
Figure 2:
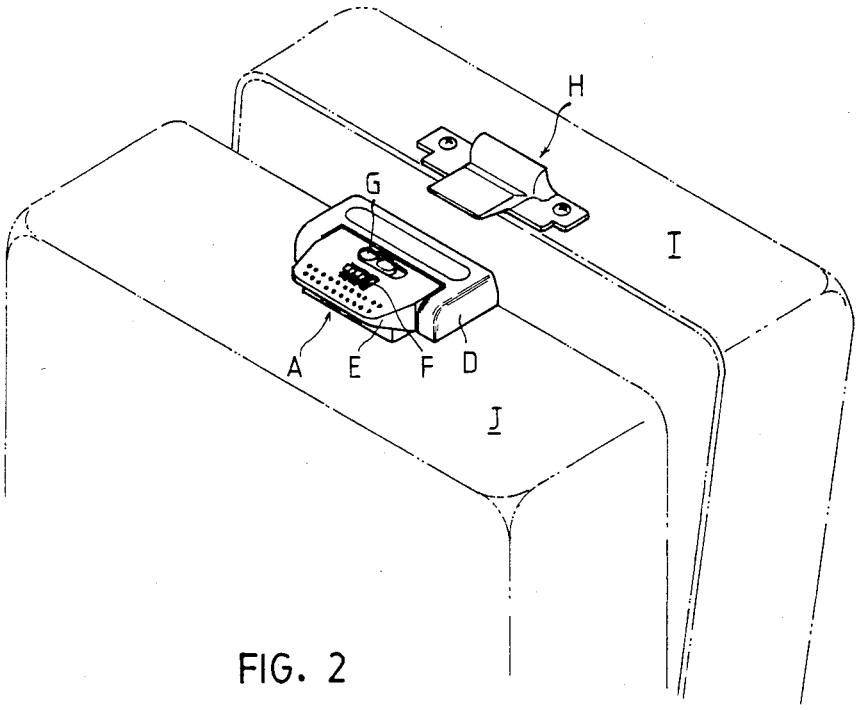
FIG. 2 is a perspective view of the combination lock of the present invention when the hasp unit and the staple unit are disengaged.
Figure 10:
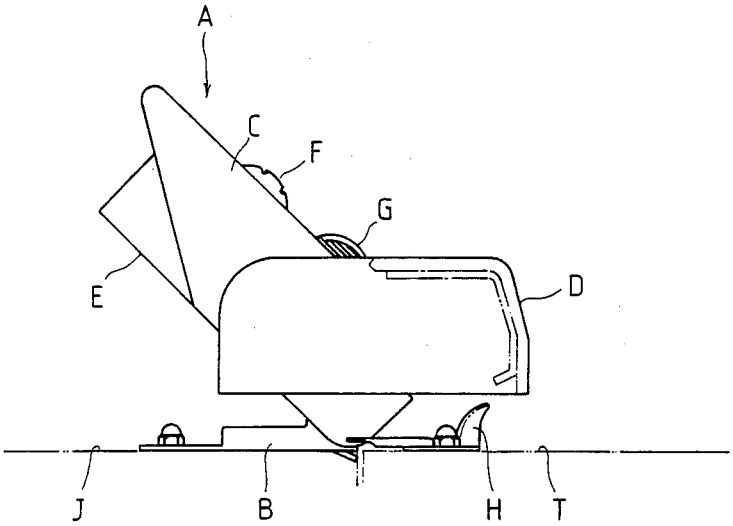
FIG. 10 is an elevational side view of the combination lock with the hasp disengaged from the staple unit.

Refering to FIGS. 2 and 10, the combination lock for luggage, brief cases and the like of the present invention consists of a hasp unit A and a staple unit H, hasp unit A being securely attached to a case body J and staple unit H being securely attached to case lid T such that hasp unit A may engage with staple unit H.

Hasp unit A comprises a base plate B, a locking unit C pivotally connected to base plate B and a hasp D pivotally connected to locking unit C. Locking unit C further comprises a body E, a combination lock F and a securing mechanism G.

Figure 3:
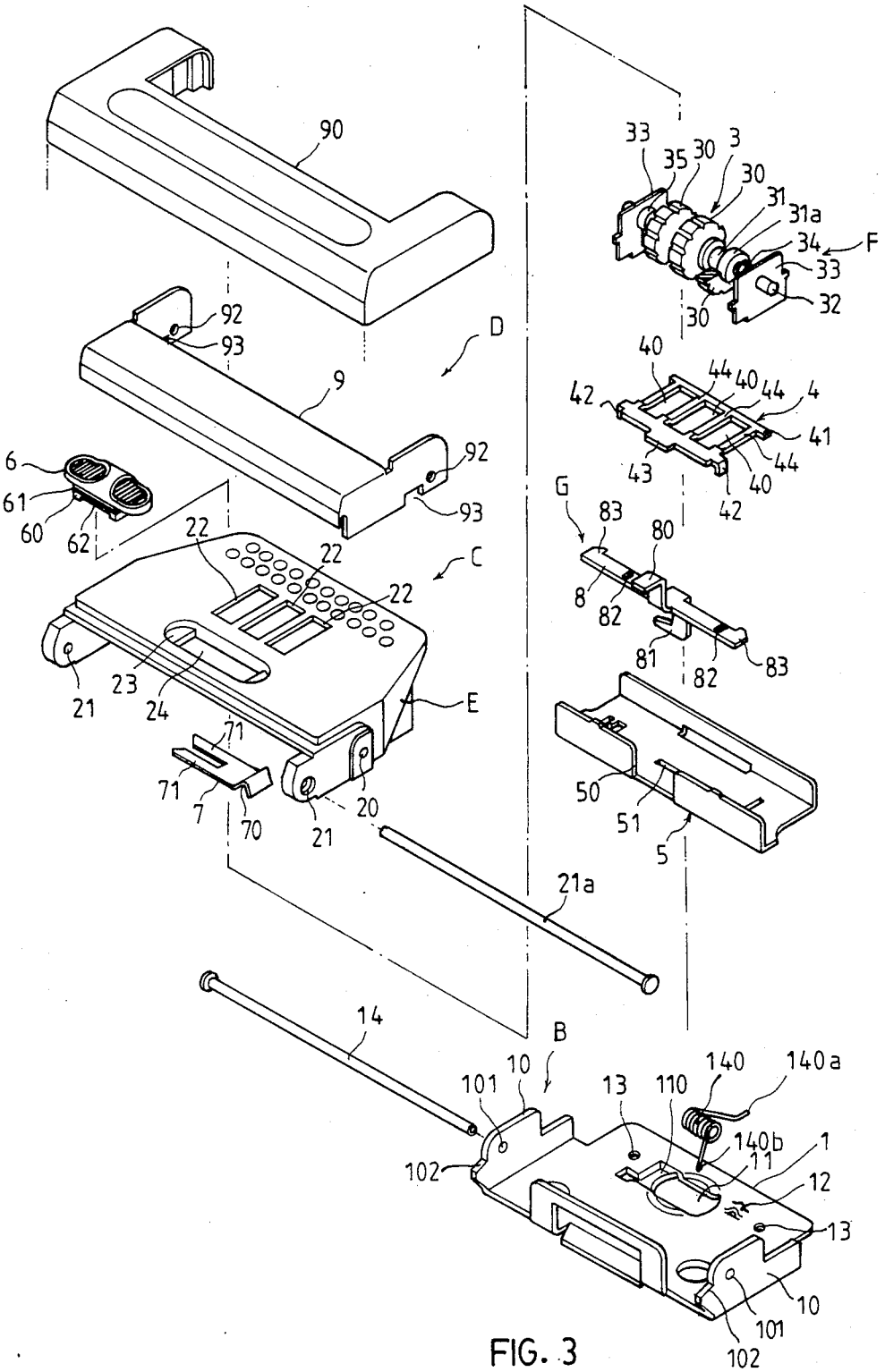
FIG. 3 is an exploded perspective view of the hasp unit of the combination lock of the present invention.
Figure 8:
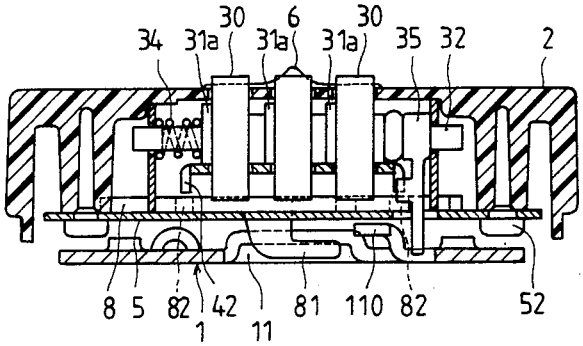
FIG. 8 is a cross section view taken along VIII—VIII line as shown in FIG. 7 to show the vertical arrangement of locking unit and base plate.

Base plate B, as shown in FIG. 3, is generally formed into a rectangular plate 1 with two side walls 10, 10, each side wall 10 having a hole 101 through which a pivot shaft for connecting body E of locking unit C thereto may pass and a shoulder 102 for limiting the rotation of body E of locking unit C. Base plate B is further provided with a rectangular opening 11 having an arch 110 at one end, an eyelet 12 and a pair of screw-threaded holes 13 for securing base plate B to case body J by two screws 52 (FIG. 8).

Body E of locking unit C is provided with two pairs of holes 20, 20, 21, 21 on the both side walls. When connecting base plate B to body E, pivot shaft 14 will pass through holes 21, 101, 101, 21, with side walls of base plate B 10, 10 disposed inside side walls of body E and a torsion spring 140 mounted thereon with one foot **140*a* fitted into eyelet 12 of base plate B and the other foot 140*b* attached to the shaft for connecting body E and hasp D, thus causing body E to be pivotally mounted and resiliently laid on base plate B. Three slots 22, 22 and 22 are formed side by side generally in the central portion of body E. In the vicinity of the front ends of slots 22 there is formed an oval recess 23 having a central opening 24. Body E, on its lower side as seen in FIG. 5, is further provided with two parallel grooves 25, 26, neighboring one end of opening 24 which allow leaf spring 7** of securing mechanism G to resiliently fit therein, to be described later.

As shown in FIGS. 3, 5, 7, 8, 9, combination lock F, substantially similar in construction to conventional combination locks, consists of a dial assembly 3, a latching piece 4 and a casing 5. Dial assembly 3 employs a shaft 32 supported by a pair of supporting plates 33, 33 at each end thereof; three sleeves 31, each having a flange **31*a* at one end, being rotatably mounted on shaft 32, flange 31*a* consisting of a round arch portion and a flat portion; three dial wheels 30 bearing ten numerals from 0 to 9 equally spaced around the outer circumference, each dial wheel 30 rotatably mounted on the shank portion of sleeve 31; a coil spring 34 disposed in between supporting plate 33 and flange 31*a* mounted on the left side and a collar 35 disposed in between supporting plate 33 and sleeve 31 mounted on the right side. Latching piece 4, generally in rectangular form, is provided with three slots 40 corresponding to dial wheels 30; two lugs 41 pivotally supported by supporting plates 33, 33 to act as a pivot axis of latching piece 4; a latch end 42 being formed on each front lateral edge thereof and a projection 43 formed on the front edge of the free end. Latching piece 4 is further provided with a spring (not shown), which may be a leaf spring or wire spring, disposed in between latching piece 4 and casing 5 to cause latching piece 4 to be resiliently and upwardly biased. Casing 5 is generally U-shaped in cross section and provided with a recess 50 on the front wall through which may be extended arm 80 of securing mechanism G and in which is fitted projection 43 to ensure that the free side of latching piece 4 will pivot without lateral movement; and a slot 51** formed in the central portion of the bottom.

Figure 5:
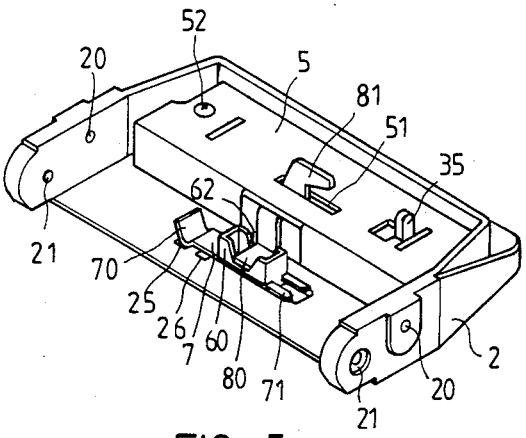
FIG. 5 is an oblique, perspective view of the locking unit of the combination lock of the present invention as shown in FIG. 3 with a combination lock assembled, being turned upside down to show the detail of its lower side.
Figure 6:
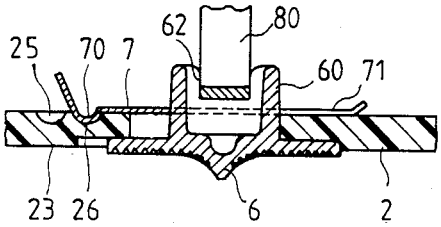
FIG. 6 is a partial cross section view of the securing mechanism of the locking unit of the combination lock of the present invention, showing the connection among knob, leaf spring and arm of sliding piece thereof.
Figure 7:
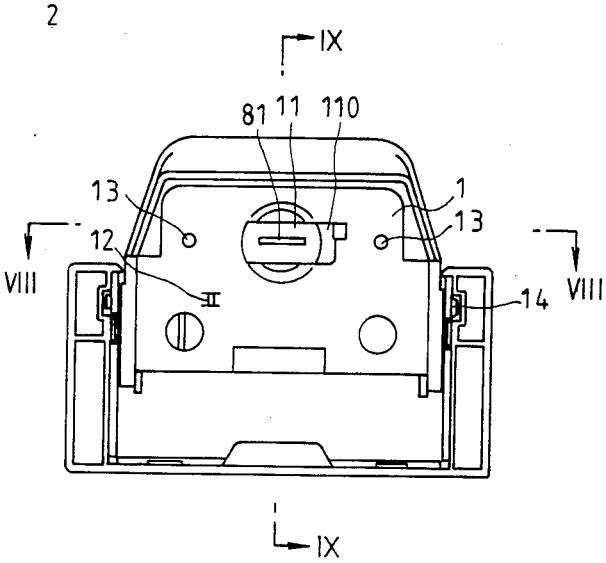
FIG. 7 is a plan view of the combination lock of the present invention with the base plate assembled, being turned upside down to show the arrangement of locking unit, base plate and hasp of the securing mechanism.

Securing mechanism G, as shown in FIGS. 3, 5 and 6, comprises a knob 6, a leaf spring 7 and a sliding piece 8. Knob 6, a block adapted to be laid into and slidable in recess 23 of body E, is provided with a stem 60 extending from the lower side thereof and slidably extending through central opening 24 of recess 23; a slit 61 on each side of stem 60, extending in the same direction as the sliding movement of stem 60, and a recess 62 in which the arm 80 of sliding piece 8 may be connected. Leaf spring 7 is provided with a bent portion 70 at one end and two blades 71 extending longitudinally in a parrallel relation. When knob 6 is assembled in recess 23 with stem 60 passing through central opening 24, blades 71 of leaf spring 7 are fitted into slits 61 to cause knob 6 and leaf spring 7 to be engaged with each other, and bent portion 70 is therefore to resiliently and selectively fit into groove 25 or 26 such that sliding piece 8 may be held at a "secure" or "release" location if knob 6 is slid to one of these positions, to be described later. Sliding piece 8 is primarily a narrow sheet adapted to be slidably disposed between latching piece 4 and the bottom of casing 5 of combination lock F, and is provided with an arm 80 adapted to be fitted into and connected with recess 62 of knob 6; a hook 81 adapted to slidably pass through slot 51 of casing 5 so as to engage with and disangage from arch 110 of base plate B; and two holes 82, 82 corresponding to latch ends 42 of latching piece 4 when sliding piece 8 is moved to "secure" by pushing knob 6. At each end of sliding piece 8 a projection 83 is formed to limit the sliding distance thereof.

Figure 9:
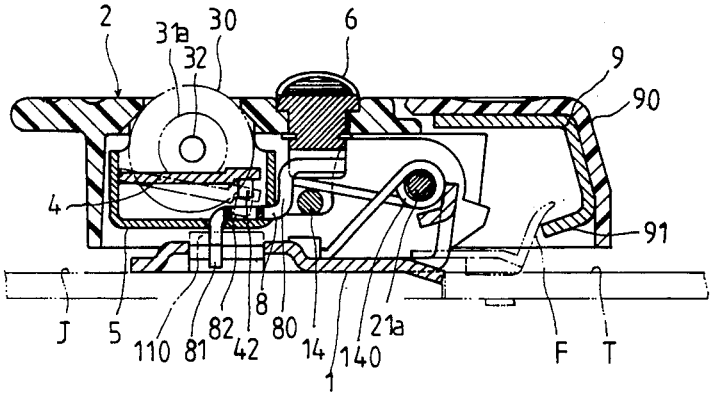
FIG. 9 is a cross section view taken along IX—IX line as shown in FIG. 7 to show the vertical arrangment of locking unit, base plate and hasp of the combination lock of the present invention.

When dial assembly 3, latching piece 4 and casing 5 of combination lock F and knob 6, leaf spring 7 and sliding piece 8 of securing mechanism G are installed inside body E of locking unit C, as shown in FIGS. 5, 8, 9, dial assembly 3, latching piece 4 and sliding piece 8 are first assembled in casing 5 with arm 80 and hook 81 of sliding piece 8 respectively and slidably extending through recess 50 and slot 51 of casing 5, latching piece 4 pivotally disposed under dial wheels 30 by pivotally fixing lugs 41 onto supporting plate 33, flange **31*a* rotatably in contact with side frame 44 of slot 40, projection 43 being capable of swinging within recess 50, supporting plates 33 fixed between two side walls of casing 5, projections 83 disposed outside two supporting plates 33, and latch ends 42 directing toward sliding piece 8. Then the assembled unit of dial assembly 3 latching piece 4, sliding piece 8 and casing 5 is attached to the lower side of body 2 by screws 52 with the upper portion of each dial wheel 30 passed through each slot 22 and projected from the surface of body 2, and the end of arm 80 of sliding piece 8 fitted into recess 62 of knob 6**.

Figure 4:
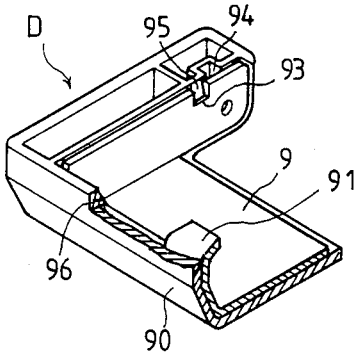
FIG. 4 is an oblique, perspective view of a section of the hasp of hasp unit of the combination lock of the present invention as shown in FIG. 3, being turned upside down to shown the detail of its lower side.

Hasp D consists of an inner body 9 of steel and an outer shall 90 of plastic, as shown in FIGS. 3 and 4, inner body 9 being removably attached to the inner side of shell 90 by the grasping force from the elasticity of shell 90. Inner body 9 is provided with a hasp member 91 on the lower edge thereof; a hole 92 on each side wall; and a recess 93 on each lower edge of the side wall thereof. At the positions on inner side walls of shell 90, adjacent to holes 92, 92, there is provided recesses 94, 94 in which the protruding ends of pivot shaft **21*a* connecting body E to hasp D may be received. Shell 90 is further provided with projections 95, 95 to fit into recesses 93, 93 and two projections 96, 96 to abut against the lower edge of inner body 9 such that inner body 9 will be grasped firmly. Hasp D is pivotally connected to body E of locking unit C by fitting body E into hasp D and passing pivot shaft 21***a* through holes 93, 20, 20, 93 with the protruding end (not shown) thereof received in one of recesses 94 of shell 90.

The locking and securing operation of the combination lock for luggage cases of the present invention will now be described. In the construction as mentioned above, when knob 6 of securing mechanism G is pushed to "secure", sliding piece 8 slides to where holes 82 are in alignment with latch ends 42 of latching piece 4, and dial wheel 30 is allowed to be rotated to "lock combination", with frames 44 being pressed by the round arch portion of flange 31*a*, the free side of latching piece 4 swings downward and latch ends 42 insert themselves into holes 82 of sliding piece 8 thus blocking the movement of sliding piece 8. If dial wheels 30 are rotated to "open combination", the free side of latching piece 4 swings upward to where frames 44 contact the flat portion of flange 31*a* by the resilient force of spring (not shown), and latch ends 42 retreat from holes 82 of sliding piece 8 thus restoring the sliding movement of piece 8. Namely, knob 6 is able to be slid back and forth between "release" and "secure" when dial wheels 30 are in "open combination" when latch ends 42 have left holes 82. Similarly, dials wheels 30 are not permitted to rotate if knob 6 is on "release" and thus blocking latch ends 42 of latching piece 4 by sliding piece 8. When knob 6 is on "secure", hook 81 of sliding piece 8 in also moved to engage with arch 110 of base plate B, locking unit C is therefore secured to base plate B and hasp D is not allowed to disengage from staple unit H, although dial wheels 30 are rotated to "open combination".

To open the luggage case having a combination lock of the present invention fixed thereon, put knob 6 in "secure" if it is in "release", then rotate dial wheels 30 to open combination and slide knob 6 to "release" to have hook 81 moved to disengage from arch 110 of base plate B, locking unit C is therefore about to be pivoted around pivot shaft 21*a* so as to lift and turn hasp D so that hasp member 91 of hasp D is freed from staple unit H as shown in FIG. 10.

The closing and locking operation of the luggage case may be accomplished by reversing the steps as mentioned above. Once knob 6 is put on "secure" and hook 81 being in engagement with arch 110 of base plate B, locking unit C will always be firmly secured to base plate B even if dial wheels 30 are occasionally subject to an unexpected and accidental rotation by other articles.

Based on the above, the disadvantages of conventional combination lock for luggage cases or the like have been resolved by the securing mechanism described in the present invention.

What is claimed is:

1. A combination lock for luggage case or the like, comprising:

a staple unit attached to one portion of a luggage case such as case lid; and a hasp unit attached to the other portion of a luggage case such as case body, comprising a base plate, a locking unit pivotally connected to said base plate and a hasp pivotally connected to said locking unit; the locking unit further comprising a body, a combination lock and a securing mechanism; the base plate being provided with an arch;

the body of said locking unit having a plurality of slots formed side by side to allow the dial wheels of said combination lock to fit in; said combination lock of locking unit further comprising a dial assembly, a latching piece and a casing, said dial assembly utilizing a plurality of dial wheels, each dial wheel being mounted on a sleeve rotatably mounted on a shaft supported inside said casing, each sleeve having a flange at one end consisting of a round arch portion and a flat portion; said latching piece being provided with a plurality of slots corresponding to said dial wheels, two lugs pivotally supported on said casing as a pivot axis of said latching piece and a latch end formed on the front thereof, round arch portion of flange of sleeve being rotatably in contact with said latching piece and pressing said latching piece downwards when dial wheels are in lock combination, flat portion of flange of sleeve being rotatably in contact with said latching piece to allow said latch piece to move upwards when dial wheels are in open combination; said securing mechanism comprising a knob being slidably fitted in said body, a leaf spring being capable of resiliently and selectively holding said knob in place when said knob is slided to and fro, and a sliding piece adapted to be slidably disposed between said latching piece and the bottom of said casing, said sliding piece comprising an arm adapted to be connected with said knob, a hook adapted to engage with or disengage from said arch of base plate to have said locking unit secured to or released from said base plate when said knob is moved to "secure" or "release", and a hole adapted to correspond to and in alignment with said latch end of said latching piece to allow latch end to fit in when sliding piece is moved to "secure" by pushing knob.

2. A combination lock for luggage cases as cited in claim 1, wherein said base plate further comprising a torsion spring having one foot engaging with said base plate and the other foot engaging with the body of said locking unit to cause said locking unit to always be flatted on base plate unless it is pivoted to lift hasp.

* * * * *

UNITED STATES PATENT AND TRADEMARK OFFICE

CERTIFICATE OF CORRECTION

PATENT NO. : 4,761,974

DATED : August 9, 1988

INVENTOR(S) : Shih Ming Lii

It is certified that error appears in the above-identified patent and that said Letters Patent is hereby corrected as shown below:

On the title page

Change the name of the assignee from

"Echolag Co., Ltd." to --Echolac Co., Ltd.--.

Signed and Sealed this

Third Day of January, 1989

*Attest:*

DONALD J. QUIGG

*Attesting Officer*

*Commissioner of Patents and Trademarks*